United States Patent [19]

Stone

[11] Patent Number: 4,599,885

[45] Date of Patent: Jul. 15, 1986

[54] COLD DRAWING A DISK INTO A CAP FOR A PAPER CORE

[76] Inventor: Harris E. Stone, 293 Lenox St., Norwood, Mass. 02062

[21] Appl. No.: 479,255

[22] Filed: Mar. 28, 1983

Related U.S. Application Data

[62] Division of Ser. No. 241,394, Mar. 6, 1981, Pat. No. 4,407,428.

[51] Int. Cl.[4] ..... B21D 22/00

[52] U.S. Cl. ..... 72/347; 72/350

[58] Field of Search ..... 72/347, 348, 349, 350, 72/351

[56] References Cited

U.S. PATENT DOCUMENTS 2,075,847 4/1937 Hothersall ..... 72/351

3,435,653 4/1969 Scaletta ..... 72/351

3,942,354 3/1976 Randolph ..... 72/351

*Primary Examiner*—Leon Gilden

*Attorney, Agent, or Firm*—Morse, Altman & Dacey

[57] ABSTRACT

Apparatus and process for cold drawing a disk into a cap for a paper core. The process comprises cold drawing a disk to form a cylindrical cup having a rim and a socket, removing the central portion of the cup leaving a flange, straightening the flange and trimming the rim. The resultant cap is characterized by having a uniform-sized rim of a width equal to the width of the socket.

The apparatus comprises a press having a fixed portion and a movable portion, a cylindrical member mounted on the fixed portion, a ram and a number of opposed cylinders carried by the movable portion, and means for moving the movable portion toward the fixed portion.

3 Claims, 8 Drawing Figures

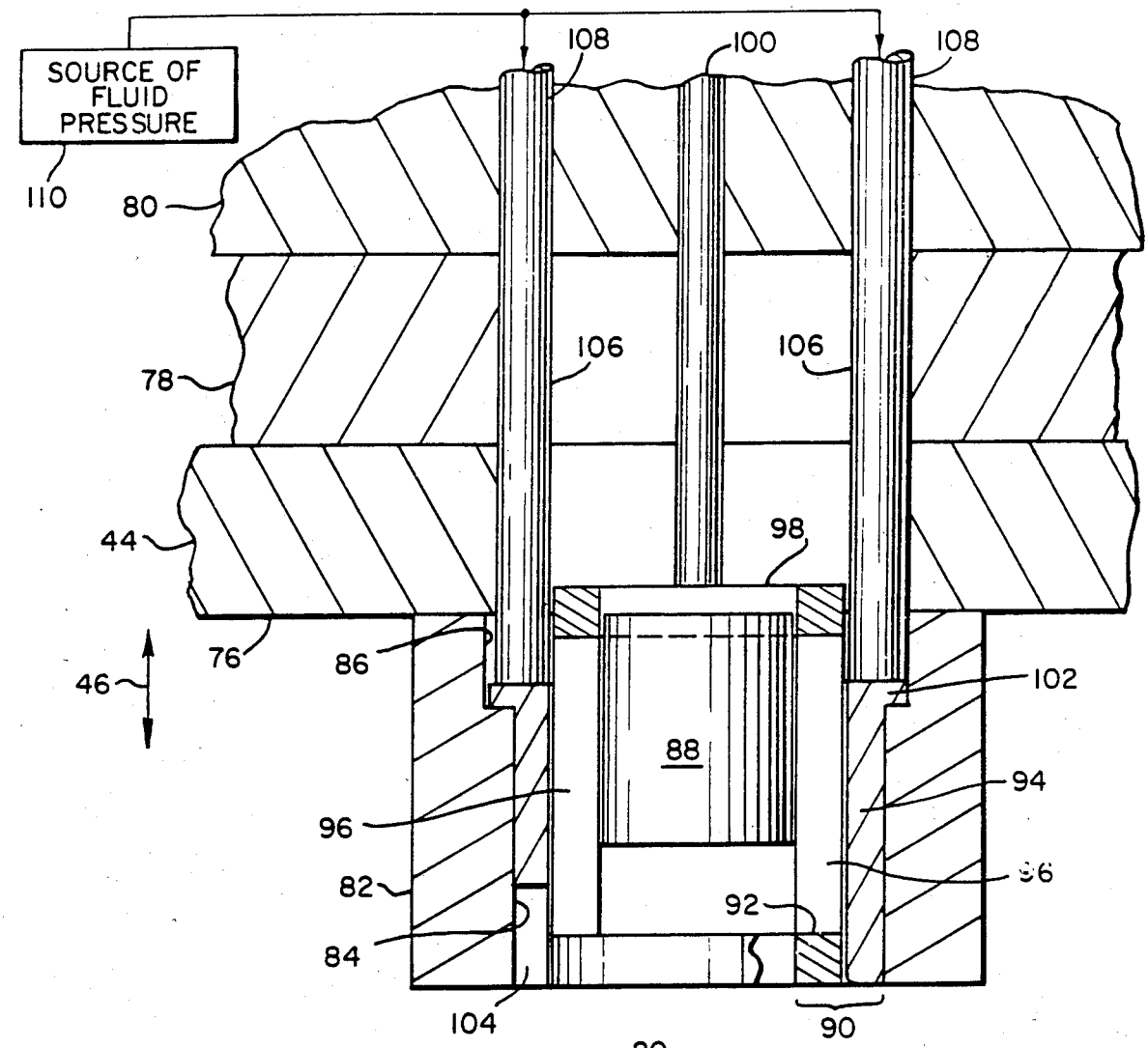
Fig. 4
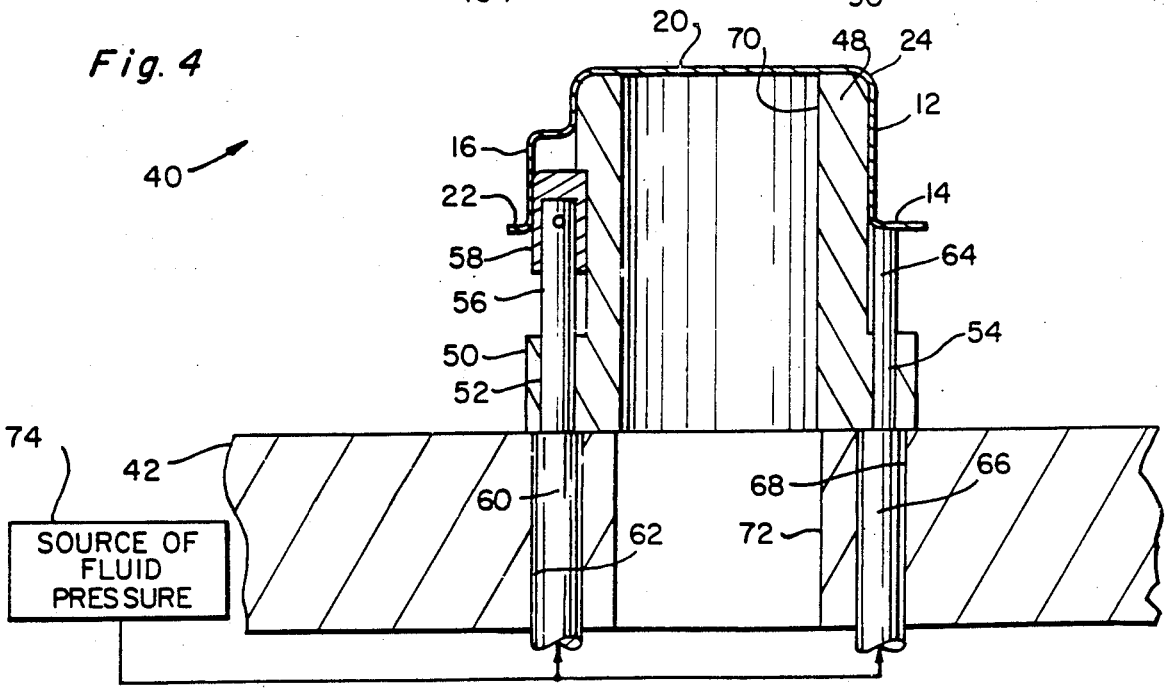

COLD DRAWING A DISK INTO A CAP FOR A PAPER CORE

This is a division of application Ser. No. 241,394 filed on Mar. 6, 1981, now U.S. Pat. No. 4,407,428.

BACKGROUND OF THE INVENTION

1. Field of the Invention

The present invention relates generally to metal caps for paper cores such as are used for rolls of newsprint and other like paper and, more particularly, to an apparatus and process for cold drawing a steel disk into a cap for a paper core.

2. The Prior Art

As disclosed in U.S. Pat. No. 4,611,552 of Philip S. Cushing et al, granted Oct. 12, 1971, paper cores used for rolls of newsprint and the like are provided with a notch in the end of the core. Metal caps designed to fit within the core are formed with corresponding sockets to be assembled within the notch. During the formation of the metal caps from steel disks, the metal for the socket is drawn from adjacent portions of a plane rim formed at the upper end of the metal cap. As a result, the rim of the cap varies in its width from zero extent on either side of the socket to a maximum width diametrically opposite to the socket. Such metal caps with variable width rims and lacking any rim at all adjacent the sockets have been characterized by structural weakness in the socket area. In addition, such metal caps have failed to provide the desired balance to the paper rolls when placed on their ends. Consequently, paper rolls, particularly heavy paper rolls, using such metal caps have a tendency easily to become unbalanced and to topple. There has existed a need, therefore, for an improved metal cap for paper cores that avoids these noted shortcomings and yet is made in a similarly economically manner.

SUMMARY OF THE INVENTION

It is a principal object of the present invention to overcome the above shortcomings by providing an apparatus and process for cold drawing a disk into a cap for a paper core, which cap is characterized by having a uniform-sized rim all around its periphery.

More specifically, it is an object of the present invention to provide an apparatus and a process for cold drawing a metal disk into a cap for a paper core, which process comprises cold drawing a disk of sheet metal to form a cylindrical cup having an oversized rim and a socket, removing the central portion of the cup leaving a flange, straightening the flange and trimming the rim. The resultant metal cap has a uniform-sized rim of a width equal to the width of the socket. Preferably, the apparatus comprises a press having a fixed portion and a movable portion, a cylindrical member mounted on the fixed portion, a ram and a plurality of opposed cylinders carried by the movable portion, and means for moving the movable portion toward the fixed portion. The cylindrical cup having an oversized rim and a socket is positioned on the cylindrical member of the apparatus. Upon displacement of the movable portion toward the fixed portion, the ram and the opposed cylinders, together with the cylindrical member, shape and form the cup into the cap.

Other objects of the present invention will in part be obvious and will in part appear hereinafter.

The invention accordingly comprises the process, the apparatus and the product of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein:

FIG. 4 is a vertical section, partly in elevation of an apparatus constructed in accordance with the present invention, with the cylindrical cup of FIG. 3 in position to be shaped and formed thereby into a cap;

DETAILED DESCRIPTION OF THE PREFERRED EMBODIMENT

Figure 1:
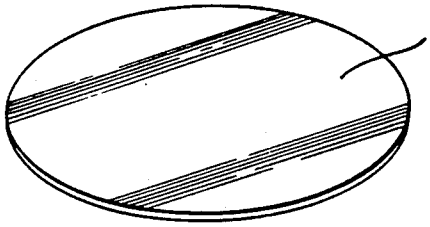
FIG. 1 is a perspective view of a circular disk of sheet metal.

Generally, the present invention provides an apparatus and a process for cold drawing a circular disk of sheet metal into an improved cap for a paper core of the kind used for rolls of newsprint and the like. Such a paper core generally is formed with a notch in an end of the core. The notch is designed so as to securely locate a metal cap in the end of the paper core.

Paper rolls are inherently out of balance, with the result that the metal end caps tend to loosen up. Thus, the greater the rim's surface of such metal end caps, the less chance for the end caps to loosen. Further, the more uniform the size of the rim all around of such metal end caps, the greater the structural strength of the end caps. The improved metal end cap of the invention is characterized in possessing greater strength and enhanced stability by having a wider rim and a uniform-sized rim all around when contrasted with caps known to the prior art, note U.S. Pat. No. 3,611,552 supra.

The process essentially comprises cold drawing a circular metal disk 10 to form a cylindrical cup 12 having a rim 14 and a socket 16. The cup 12 is formed with a tubular wall 18 and a connecting central portion 20. It should be noted that the rim 14 is oversized so as in fact forming a lip 22 extending from the socket 16. Next, the connecting central portion 20 is removed from the cup 12, leaving an arcuate portion 24 peripherally depending and extending inwardly from the tubular wall 18. This arcuate portion 24 then is straightened so that it beomes an extension 26 of the tubular wall 18. The process concludes by trimming the oversized rim 14.

Figure 8:
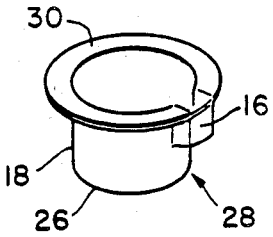
FIG. 8 is a perspective view, on a reduced scale, of the finished cap.

A finished cap 28 is shown in perspective and on a reduced scale in FIG. 8. As may be observed therein, the finished cap 28 comprises the tubular wall 18, with the extension 26 adding more length to it, the socket 16 protruding radially from the upper portion of the tubular wall 18, and a uniform-sized rim 30 formed at the top of the tubular wall 18. The uniform-sized rim 30 is formed during the trimming operation in an apparatus hereinafter to be described. It is to be noted that the rim 30 is not only of uniform size all around the periphery of the tubular wall 18, but also the width of the rim equals the width of the socket 16. As a consequence, the cap 28 exhibits extra strength, particularly in the socket 16 area. The cap 28 also possesses some extra crush strength as a whole, more specifically, a more evenly distributed crush strength. Further, the cap 28, when properly positioned in the end of a paper core of a roll of paper, imparts additional balance to the paper roll when the roll is placed on its end. It is also noted that the extension 26 to the tubular wall 18 can be formed during the straightening operation either with a straight end or with a slight bead or radius. The presence of such a slight bead or radius at the end of the extension 26 to the tubular wall 18 facilitates the insertion of the finished metal cap 28 into the end of the paper core. Once seated within the core, the bead may be smoothed out flush against the inner walls of the core by a rolling operation or the like, if desired.

The operative parts of an apparatus 40 for forming the metal cap 28 are shown in their several respective operative positions in FIGS. 4–7. The apparatus 40 essentially comprises a press having a fixed portion, such as represented by a fixed frame 42, and a movable portion 44 designed to be displaced to and from the frame 42, as indicated by a double-headed arrow 46. A cylindrical member 48 is secured to the fixed frame 42 and is shaped so as to receive the cylindrical cup 12 having the oversized rim 14, the socket 16 and the lip 22 extending from the socket 16, observe FIG. 4. In this normal or loading position, the movable portion 44 of the apparatus 40 is positioned spaced apart from the fixed frame 42 so that an operator can position the cylindrical cup 12 on the cylindrical member 48, as shown. The member 48 is formed with a shoulder 50 whose significance will become apparent below. The shoulder in turn 50 is formed with two bores 52 and 54. Bore 52 is designed to accommodate a member 56 carrying at its upper end a lug 58 and connected at its lower end to a rod 60. Rod 60 is accommodated within a bore 62 formed in the fixed frame 42. Bore 54 on the other hand is designed to accommodate a finger 64 that is also connected at its lower end to a rod 66. Rod 66 in turn is accommodated within a further bore 68 formed in the fixed frame 42. Cylindrical member 48 is formed with an axial hole 70, and a coaxial hole 72 is also provided in the fixed frame 42. A source 74 of fluid pressure is connected to the underside of the rods 60 and 66, respectively to urge the rods 60 and 66 upwards so as to maintain the lug 58 and the finger 64 in their respective fully-extended position, as shown in FIG. 4. It will be observed that the fully-extended position is reached when the rods 60 and 66 abut against the underside of the cylindrical member 48 since the bores 52 and 54 are smaller and hence cannot accommodate the rods 60 and 66. Preferably, the source 74 is a pneumatic pressure, such as factory air of about thirty p.s.i., and this pressure is maintained and exerted against the underside of the rods 60 and 66 at all times during the operation of the apparatus 40.

The movable portion 44, as mentioned, represents the upper part of a mechanical press, preferably a sixty ton or so mechanical press. Movable portion 44 includes a plurality of platens 76, 78 and 80 secured to one another. The lower platen 76 carries another cylindrical member 82, secured to the platen 76 so as to be concentric with the cylindrical member 48 secured to the fixed frame 42. As will be observed, cylindrical member 82 is larger than the cylindrical member 48, with member 48 designed to be accommodated within a central opening 84 of the member 82. At the upper end, the central opening 84 widens into a larger opening 86. Concentrically mounted within the central opening 84 and also secured to the platen 76 is a ram 88. An annular space 90 surrounds the ram 88 and separates it from the wall of the central opening 84. There are two movable members, designed to be axially displaced about the ram 88, accommodated within this annular space 90: an annular ring 92 and an annular sleeve 94. The annular ring 92 is normally flush with the end of the cylindrical member 82 and is connected by a pair of legs 96, 96 to a cross bar 98. A rod 100 in turn is connected centrally to the cross bar 98.

The annular sleeve 94 is formed at its upper end with a shoulder 102 designed to be accommodated within the larger opening 86. At its lower end, the sleeve 94 is formed with a cut-out portion 104 designed to accommodate the lugs 58, as will be more apparent from below. A plurality of rods 106, disposed for axial displacement within suitable bores 108 formed in the platens 76, 78 and 80, bear down on the shoulder 102 of the sleeve 94. Preferably, at least four such rods 106 are provided to equalize the pressure on the sleeve 94. The downward pressure is shown effected by a further source 110 of fluid pressure, shown bearing down on the upper ends of the rods 106. Preferably, this source 110 of fluid pressure is nitrogen pressure of about 800 p.s.i. There is, however, no pressure of any kind applied to the rod 100 connected to the cross bar 98. Before describing the operation of the apparatus 40, the formation of the cylindrical cup 12 need briefly to be described.

Figure 2:
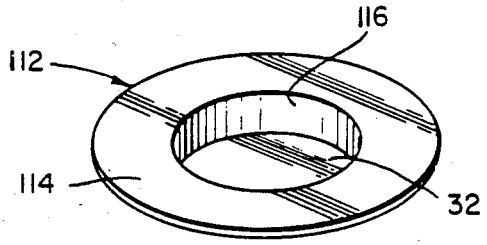
FIG. 2 is a perspective view of a shallow cup formed by cold drawing the disk shown in FIG. 1.

The circular metal disk 10, preferably formed of steel, first is subjected to a cold drawing step, during which step its central portion 32 is depressed somewhat. The resulting step product 112, illustrated in FIG. 2, is in the form of a shallow saucer with a wide plane rim 114 and a shallow side wall 116. This intermediate step product 112 is then subjected to a second cold drawing operation. During this second cold drawing operation, the central portion 32 is depressed even further and also the socket 16 is pressed outward. The resultant deeper cylindrical cup 12 is shown in and has been described with reference to FIG. 3. Cup 12 is formed with the tubular wall 18, the socket 16 and the concentric central portion 20 connecting with the wall 18 via the peripheral arcuate portion 24. More significantly, the cup 12 possesses an oversized rim 14 which is of lesser size to be sure than the wide plane rim 114 of the intermediate step product 112, yet large enough to provide the socket 16 with its lip 22. The presence of this oversized rim 14 and of the lip 22 are significant in the shaping of the finished cap 28.

Figure 3:
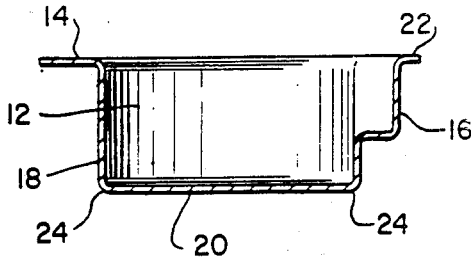
FIG. 3 is a sectional view of a deeper cylindrical cup formed from the shallow cup by a cold drawing step and having an oversized rim and a socket.
Figure 5:
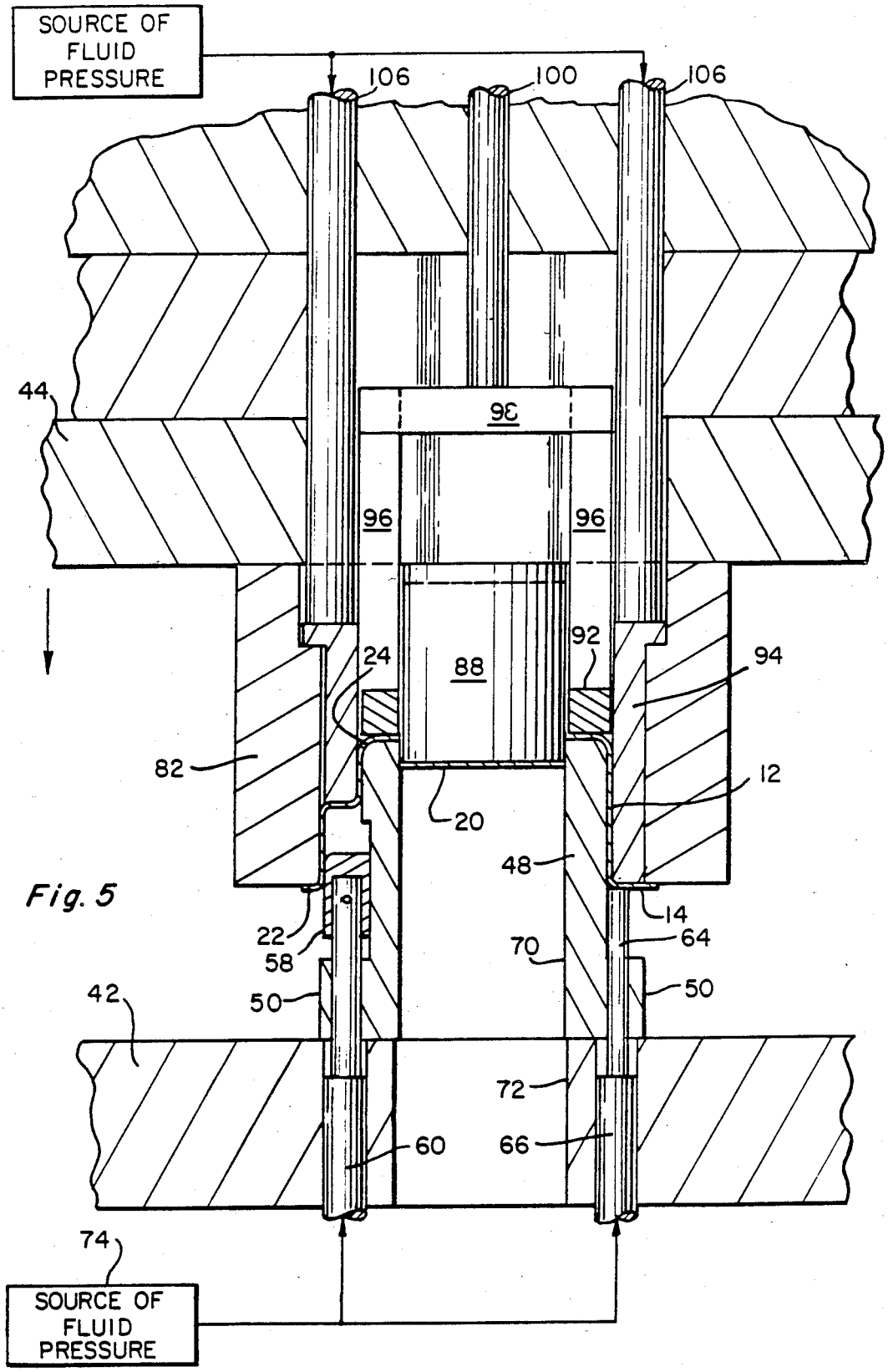
FIGS. 5–7 are views similar to that shown in FIG. 4 but showing the apparatus in different operative positions.

The deep cylindrical cup 12 of FIG. 3 is now ready to be introduced into the apparatus 40, observe FIG. 4, so as to be shaped and formed thereby into the finished cap 28 of FIG. 8 Introduction of the cup 12 into apparatus 40 is accomplished by placing the cup 12, face down, onto the cylindrical member 48 and effecting relative motion between members 44 and 48, observe FIG. 5. This relative motion is effected by command from a control panel, not shown. The control command preferably is initiated by depressing a start button on the control panel.

The first operation pertaining to the shaping and forming of the cup 12 in the apparatus 40 involves the removal of the connecting central portion 20. This operation is illustrated in FIG. 5. During this operation, the ram 88, is caused to be axially displaced within and with respect to the cylindrical member 48. At the same time, the opposed cylindrical member 82, together with the annular sleeve 94, surround the cylindrical cup 12, with the oversized rim 14 thereof being clamped between the finger 64 and the sleeve 94. It will be observed that the rods 60 and 66, have also been displaced somewhat downward since the source 110 of fluid pressure bearing on the rods 106, and thereby on sleeve 94, is far greater than the opposing force exerted by the source 74 of fluid pressure on the rods 60 and 66. By its motion, the ram 88 causes the central connecting portion 20 of the cup 12 to be punched out. During this step, the annular ring 92 freely rides on the arcuate portion 24 of the cup 12.

It will be appreciated that the movable portion 44 continues in its downward motion toward the fixed frame 42. In so doing, it begins with the sleeve 94 moving together with the cylindrical member 82, progressively to straighten the arcuate portion 24 so that it finally becomes the extension 26 of the tubular wall 18, observe FIG. 6.

It will be appreciated that in the continued downward movement of the movable portion 44 and all that it carries with it, the sleeve 94 continues to press the finger 64 progressively further downward until it will strike the shoulder 50 of the cylindrical member 48. From this point on, with further downward motion of the cylindrical member 82, the sleeve 94 begins to be displaced relative the member 82. At about the same time, the lug 58 also is caused to enter fully the socket 16 of the cup 12 so as to refine the radii thereat. With continued further downward motion, the cylindrical member 82 next causes to effect the trimming of the lip 22 and of the oversized rim 14. The trimming is in effect accomplished by the sharp shoulder 50 of the member 48 generating a shearing stress against the bottom peripheral edge of the central opening 84 of the member 82. It will be observed that sometime during this operation, the punched out central portion 20 is permitted to fall by gravity through the hole 70 of the member 48, and hence through the hole 72 to a suitable receptacle positioned under the apparatus 40.

With the trimming of the lip 22 and the rim 14, and the straightening of the extension 26, the shaping and forming of the cylindrical cup 12 into the cap 28 by the apparatus 40 is completed. The movable portion 44 is now moved upward and away from the fixed frame 42, carrying within member 82 the now completed cap 28, until member 82 is once again completely free of member 48. During this upward motion and about this time, the rod 100 strikes a stop, not shown. Thereupon and with a bit further upward motion by movable portion 44, the now arrested annular ring 92 effects the dislodgement of the finished cap 28 from within the central opening 84 of the member 82. The dislodged finished cap 28 then falls by gravity onto a conveyor belt, not shown, operatively mounted adjacent the cylindrical member 48. Whereupon a next cycle of operation begins by the operator placing another cylindrical cup 12 on the member 48.

It will be noted particularly in FIG. 8 that the resultant rim 30 of the finished cap 28 has a uniform-sized width all around the periphery thereof. Furthermore, it will be noted that the width of this uniform-sized rim 30 is about equal to the width of the socket 16, which in turn is about equal to the width of the sleeve 94. Consequently, the finished cap 28, after removal from the apparatus 40 and as shown in FIG. 8, is characterized: by possessing extra strength in the socket 16 area, by exhibiting an improved balance when positioned on its rim 30, and by possessing improved crush strength and a more evenly distributed crush strength. These advantages are particularly noted when compared with caps heretofore made by cold drawing them, which prior art caps were formed with variable width rims, observe, the U.S. Pat. No. 3,611,552, all as previously mentioned.

Figure 6:
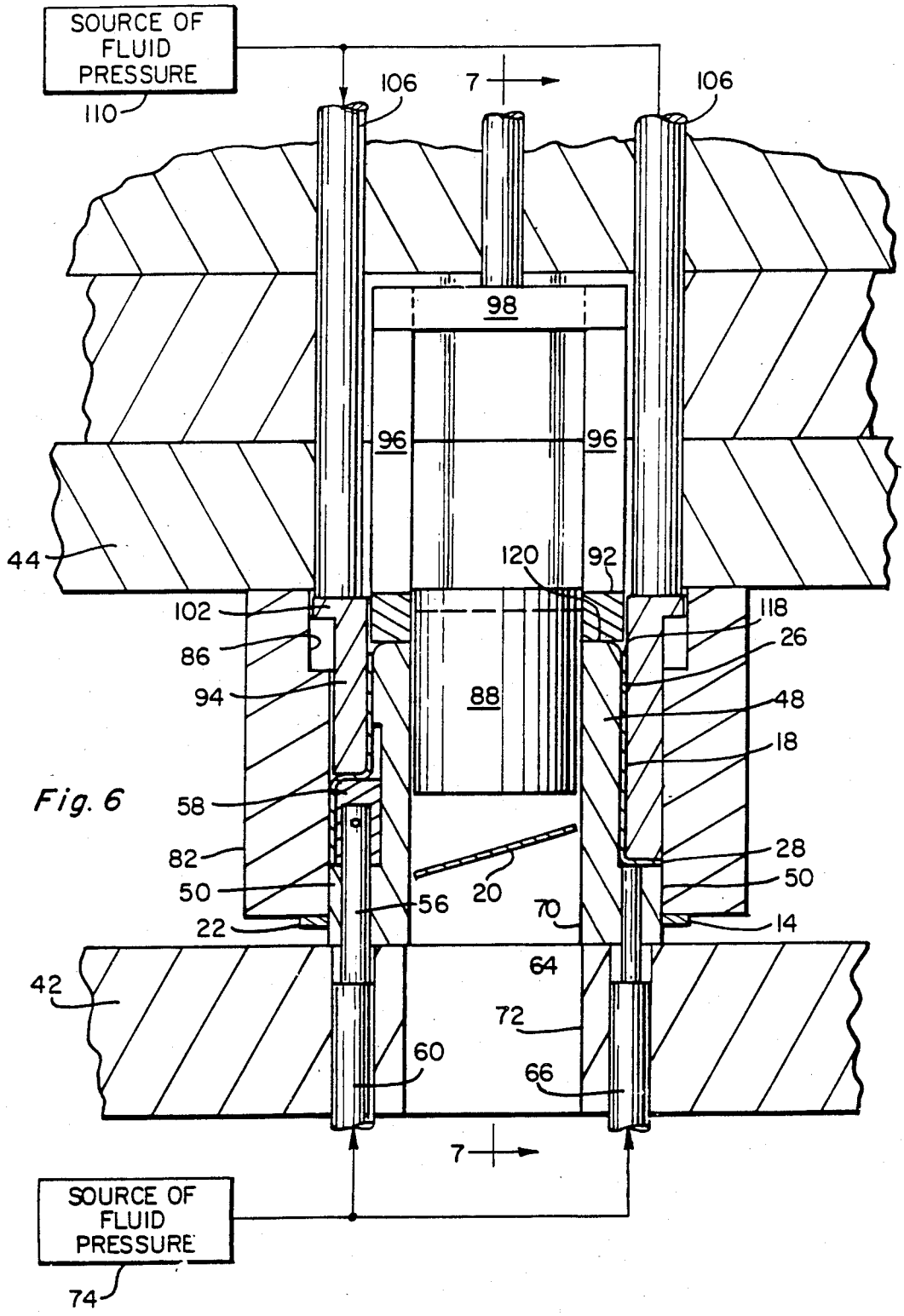
Figure 7:
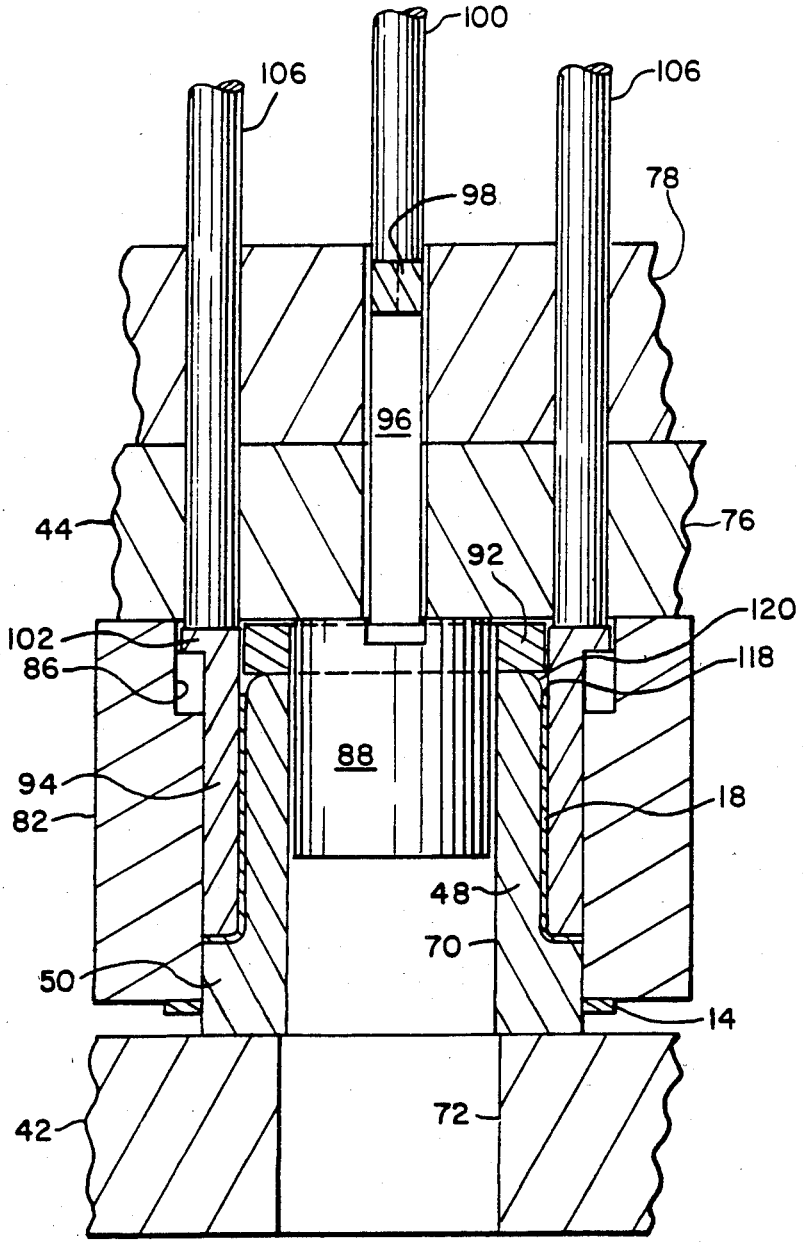

It is further pointed out that, in straightening the arcuate portion 24 of the cylindrical cup 12 so that it becomes the extension 26 of the tubular wall 18, its end 118 (observe FIG. 6) is formed straight. If it is desired to form this end 118 with a slight inwardly bent radius, this may be accomplished by not displacing the opposed cylindrical member 82 axially as much as shown in FIG. 6. Rather, the extent of axial displacement of member 82 is shortened until such time that the end 118 of the tubular wall 18 finds itself in the vicinity of the arcuately shaped end 120 of the member 48. Consequently, while the arcuate portion 24 is straightened out for most of its length, yet its very end 118 would not be straightened completely. As a result, a slight inwardly bent radius would remain at the bottom of the extension 26 of the wall 18. The resultant cap is somewhat easier insertable into a paper core than is the finished cap 28 having a straight end.

Thus it has been shown and described an apparatus and a process for cold drawing a disk 10 of sheet metal into a cap 28 for a paper core, which apparatus, process and cap 28 satisfy the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. Apparatus for forming a cap from a cylindrical cup for a paper core having a notch in an end of said core, comprising:

(a) a press having a fixed portion and a movable portion, said fixed portion including a clamping member;

(b) a cylindrical member shaped so as to receive said cylindrical cup and mounted on said fixed portion, said cylindrical member formed with an axial hole;

(c) a ram and a plurality of opposed cylinders carried by said movable portion and concentric with said cylindrical member of said fixed portion; said ram designed to be axially displaced within said hole;

(d) said plurality of opposed cylinders including an outer cylindrical member fixedly secured to said movable portion, an annular sleeve mounted for axial displacement within said outer cylindrical member, and an annular ring disposed about said ram and within said annular sleeve for free axial movement within said annular sleeve;

(e) means for moving said movable portion toward said fixed portion;

(f) said annular sleeve being displaceable relative to and away from said fixed portion when said movable portion is advanced toward said fixed portion;

(g) a source of fluid pressure bearing on said annular sleeve in a direction toward said fixed portion;

(h) whereby said outer cylindrical member and said annular sleeve are designed to surround said cylindrical cup disposed on said cylindrical member, with a rim of said cylindrical cup being clamped between said clamping member and said annular sleeve.

2. The apparatus of claim 1 wherein said means for moving said movable portion is operable by mechanical force and said source of fluid pressure is a nitrogen pressure.

3. The apparatus of claim 2 further including at least one member movably mounted within said cylindrical member and a second source of fluid pressure bearing on said movable member, wherein said fluid pressure exerted by said second source is less than the pressure exerted by said other source.

* * * * *